US008851852B2

(12) United States Patent
Blatchford

(10) Patent No.: US 8,851,852 B2
(45) Date of Patent: Oct. 7, 2014

(54) TURBINE ASSEMBLY

(75) Inventor: David Paul Blatchford, Rugby (GB)

(73) Assignee: Alstom Technology Ltd., Baden (CH)

( * ) Notice: Subject to any disclaimer, the term of this patent is extended or adjusted under 35 U.S.C. 154(b) by 675 days.

(21) Appl. No.: 12/959,562

(22) Filed: Dec. 3, 2010

(65) Prior Publication Data

US 2011/0200441 A1 Aug. 18, 2011

(30) Foreign Application Priority Data

Dec. 7, 2009 (EP) ..... 09178147

(51) Int. Cl.
*F01D 5/30* (2006.01)
*F01D 5/32* (2006.01)

(52) U.S. Cl.
CPC ..... *F01D 5/3038* (2013.01); *F05D 2230/60* (2013.01); *F01D 5/32* (2013.01)
USPC ..... 416/215

(58) Field of Classification Search
USPC ..... 416/215, 216, 218
See application file for complete search history.

(56) References Cited

U.S. PATENT DOCUMENTS

| | | | | |
|---|---|---|---|---|
| 2,414,278 | A | 7/1943 | Soderberg | |
| 3,567,337 | A | 3/1971 | Zerlauth et al. | |
| 4,465,432 | A | 8/1984 | Mandet et al. | |
| 4,818,182 | A | 4/1989 | Bouru | |
| 5,236,308 | A | 8/1993 | Czeratzki | |
| 6,299,411 | B1 | 10/2001 | Freuschle et al. | |
| 8,206,116 | B2 * | 6/2012 | Pickens et al. | 416/215 |
| 2001/0019697 | A1 * | 9/2001 | Mueller et al. | 416/218 |
| 2004/0086387 | A1 | 5/2004 | Fitts et al. | |
| 2006/0257259 | A1 | 11/2006 | Blatchford et al. | |
| 2007/0014667 | A1 | 1/2007 | Pickens et al. | |
| 2008/0267781 | A1 | 10/2008 | Becker | |
| 2010/0183444 | A1 * | 7/2010 | Stone | 416/220 R |
| 2011/0110782 | A1 * | 5/2011 | Brittingham | 416/215 |

FOREIGN PATENT DOCUMENTS

| | | |
|---|---|---|
| CH | 357414 | 10/1961 |
| CN | 1499043 A | 5/2004 |

(Continued)

OTHER PUBLICATIONS

European Search Report for EP Patent App. No. 09178147.6 (Jun. 11, 2010).

(Continued)

*Primary Examiner* — Edward Look
*Assistant Examiner* — Jeffrey A Brownson
(74) *Attorney, Agent, or Firm* — Buchanan Ingersoll & Rooney PC

(57) ABSTRACT

A turbine assembly includes a rotor (1) with a channel (20) and a plurality of blades (10) with a root (30) rotationally fitted in the channel (20). The root (30) and channel (20) have complimentary angled end walls (26, 36) while the root (30) is further configured to have radial play in the channel (20). The combination of this radial play and end wall angle enables, when the base (31) of the root (30) is in contact with the base (21) of the channel (20), enable over-rotating compared to when the base (31) of the root (30) and channel (20) are not in contact. This over-rotation enables the fitting of a last root (30) in the channel (20).

8 Claims, 3 Drawing Sheets

(56) References Cited

FOREIGN PATENT DOCUMENTS

| | | | |
|---|---|---|---|
| CN | 1950590 | A | 4/2007 |
| DE | 102005048883 | | 4/2007 |
| EP | 0707135 | | 4/1996 |
| EP | 1865153 | | 12/2007 |
| GB | 1432994 | | 4/1976 |
| GB | 2156908 | | 10/1985 |
| GB | 2171150 | | 8/1986 |
| JP | 2000-234502 | A | 8/2000 |
| JP | 2004-169552 | | 6/2004 |
| JP | 2006-112426 | A | 4/2006 |

OTHER PUBLICATIONS

Search Report for German Patent App. No. 10 2010 053 141.3 (Mar. 7, 2012).

Office Action (Notification of Reasons for Refusal) issued on Mar. 10, 2014, by the Japanese Patent Office in corresponding Japanese Patent Application No. 2010-272717, and an English Translation of the Office Action. (4 pages).

Office Action issued on Mar. 5, 2014, by the Chinese Patent Office in corresponding Chinese Patent Application No. 201010590160.8, and an English Translation of the Office Action. (17 pages).

* cited by examiner

TURBINE ASSEMBLY

This application claims priority under 35 U.S.C. §119 to European Application No. 09178147.6, filed 7 Dec. 2009, the entirety of which is incorporated by reference herein.

BACKGROUND

1. Field of Endeavor

The disclosure relates generally to turbines and specifically to rotors and rotor blades that are rotationally fitted therein.

2. Brief Description of the Related Art

Known fastening arrangements for fitting blades into rotors to form a blade row include pinned roots and side entry fir trees. Each of these configurations requires side access, which, in steam turbines, places limitations on the steam path design. An alternative structure for fitting blades that does not have this disadvantage uses a so-called straddle root. While this does not require side access, a fitting window in the rotor is required and this window creates a weak point. A yet further blade fitting involves rotational fitting.

Rotationally fitted blades may have either T- or L-shaped roots as, for example, disclosed in U.S. Pat. No. 5,236,308. Both the T- and L-shaped roots may be rotationally fitted and fixed into a complimentary shaped channel. As the axial length of the root is typically greater than its circumferential width, the space required to rotational fit a root is greater than the circumferential space it requires when it is operationally aligned. In order to create additional fitting space, the blade's roots may be configured for over-rotation in the channel, as, for example, described in GB 2 171 150 A by having a parallelogram shaped platform and/or root and further by reducing the circumferential width of the root, below its required width, and then filling the resulting gap, after fitting of the all the blades of a blade row, with shims. Alternatively, as described in U.S. Pat. No. 3,567,337, the blade root foot and rotor slot may be configured to each include at least one lateral surface which is sloped so as to engage the blades in opposition to centrifugal force while allowing fitting and rotation of the blade root in the rotor slot. In these configurations shims both fill the gap and locate the blades in position. Exemplary shims are disclosed in U.S. Pat. No. 6,299,411 B1. A problem with shims is that their production costs are high, partly due to the need for skilled operatives and partly due to the complexity and cost of the shims themselves. In addition, their fitting demands time, impacting blade assembly and disassembly time. JP2004169552A provides an alternative method of blade fixing that involves inserting a spacer between the base of the blade root and channel bottom. A similar spacer used in conjunction with shims is also described in U.S. Pat. No. 3,567,337. As it may not be possible to insert the spacer after the fixing of the blades, the solution increases complexity and in addition does not address the problem of circumferential gaps between roots.

A further alternate locking device, described in GB 2171 150 A, makes use of a bolt and thread to fix the blade into position at a fixed stagger angle.

As an alternative, the solution described in U.S. Pat. No. 7,168,919 B2, provides a blade root with a staggered abutment. During assembly, this abutment enables circumferentially alignment of the root in a way that closes the gap between blades when the roots are in their final operational alignment.

The arrangement is, however, limited to assemblies with shrouded blades in which the blade portions are pre-twisted such that, in the final assembled position, radial alignment of the circumferential abutment and the shroud portions provides a torsional bias that maintains the shroud in pressure and frictional contact with its neighbors. This contact is needed to resist radial movement. Further, the need to over-twist the shrouds of blades fitted with the described blade roots during fitting in order to create the necessary gap to fit the penultimate blade, in view of the require torsional bias, adds installation complexity and as a result impacts assembly time.

SUMMARY

One of numerous aspects of the present invention relates to the problems of fitting and/or fixing rotationally fitting blades in a channel.

Another aspect of the present invention relates to the general idea of enabling over-rotation of blade roots in a rotor channel by a combination of radial play of the root foot and neck taper angle of the channel and the root and the parallelogram shape of the platform and/or root. The additional space within the blade row created by the over-rotation increases the space for fitting of additional roots in the channel. In particular, this enables the fitting of a last blade in the blade rows without the need for channel windows. In operation, the roots, by centrifugal forces, are forced radially outwards. In this way, the interaction of the angled root and channel end walls prevents over-rotation and thus the blade roots are circumferentially fixed in the blade row, thus the correct stagger angle is fixed, and over- or under-rotation during operation is prevented. As a result, shims between roots are not required and nor are shrouds that impose torsional bias that prevent rotation, as rotation is not possible. Embodiments can therefore be applied to both shrouded and non-shrouded blades while providing the advantage of significantly reduced blade fitting time, as shims can either be reduced in number or totally eliminated.

An aspect provides a turbine assembly comprising a rotor and blades. The rotor has a rotational axis, an outer surface, and a channel that is formed in the outer surface circumscribing the rotor. The channel also includes an axially extending foot and a neck portion. The axially extending foot has a base and a radially inward facing land: the radial distance therebetween defines the foot radial height. The neck portion, extending radially between the foot and the outer surface, has a first and a second axial end wall, one or each having a taper angle. In the radial outward direction, this taper angle narrows the neck portion. Located in the channel is a row of circumferentially distributed, rotationally fittable blades. Each blade comprises a root, at least partially located in the channel, that includes an axially extending foot and a neck. The foot has a base and a radial height extending from the base, while the neck, extending radially from the foot, has a first and a second axial end wall. Each of the end walls is tapered to compliment the taper angle, or absence thereof, of the channel neck portion. The shape of the foot and the neck of the root generally compliment the shape of foot and neck of the channel. The radial height of the root foot is less than the radial height of the channel foot. This element together with the taper allows over-rotation of the root in the channel when the roots base is in contact with the channel base, compared to when the root foot is in contact with the channel land, to an extent that enables the fitting of a last blade in the channel root. By this, shims are superfluous. In addition, torsional bias is not required to align and fix the blades as the blades may be fixed merely by operational centrifugal forces.

Other aspects and advantages of the present invention will become apparent from the following description, taken in connection with the accompanying drawings wherein by way of illustration and example, an exemplary embodiment of the invention is disclosed.

BRIEF DESCRIPTION OF THE DRAWINGS

By way of example, an embodiment of the present disclosure is described more fully hereinafter with reference to the accompanying drawings, in which.

DETAILED DESCRIPTION OF EXEMPLARY EMBODIMENTS

Figure 1:
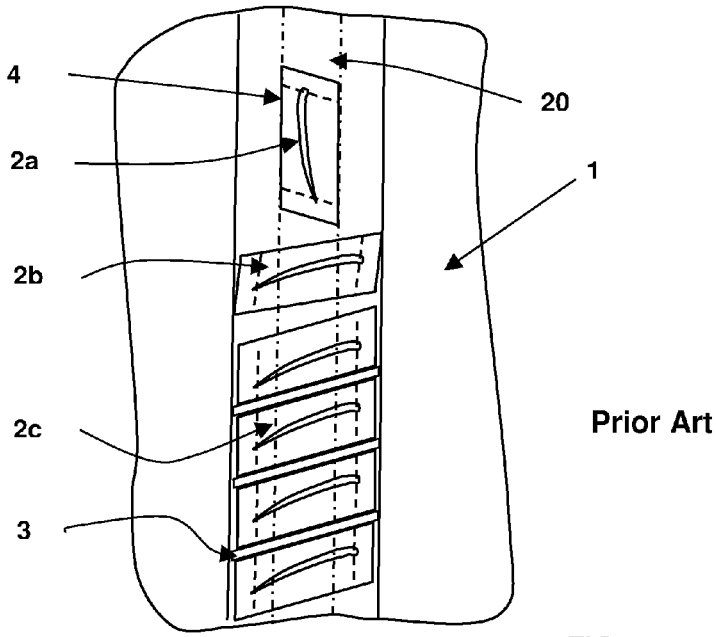
FIG. 1 is a prior art arrangement showing the rotational fitting of blade into a rotor and the use of blade shims

Preferred embodiments of the present invention are now described with reference to the drawings, wherein like reference numerals are used to refer to like elements throughout. In the following description, for purposes of explanation, numerous specific details are set forth in order to provide a thorough understanding of the disclosure. It may be evident, however, that the disclosure may be practiced without these specific details.

FIG. 1 shows a prior art blade assembly having blades 2 in various states of being fitted into a rotor 1. Each of the blades 2 has a parallelogram shaped platform and/or root 4 wherein the parallelogram shape allows them to be fitted by over-rotation. The fitting is performed by fitting each blade 2*a* into the channel of the rotor 20 while other, already fitted blades 2*b* are over-rotated to provide addition space in the channel 20. Once all blades 2*c* are fitted, the correct blade stagger angle is achieved by the fitting shims 3 between the blade platforms/roots 4.

Figure 2:
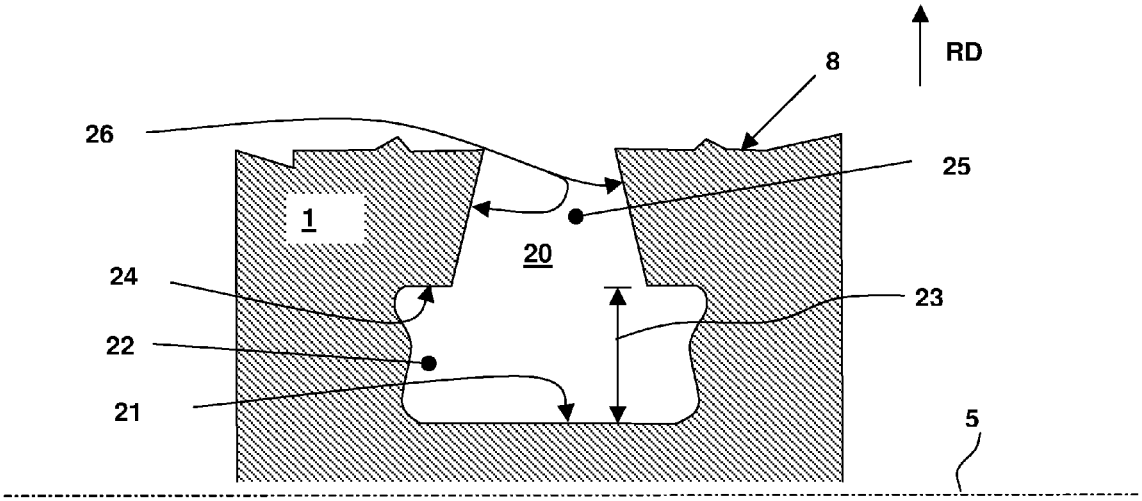
FIG. 2 is a sectional view of a rotor of an exemplary embodiment.

FIG. 2 shows a longitudinal sectional view of part of a rotor 1 of an exemplary embodiment of a turbine assembly. The rotational axis 5 of the rotor corresponds to its longitudinal axis. In the exemplary embodiment, the rotor 1 has a channel 20 that is formed in an outer surface 8 and circumscribes the rotor 1. The channel 20 includes an axially extending foot 22 and a neck portion 25, wherein the radial end of the foot 22 and the neck portion 25 define the radial limits of the channel 20.

The foot 22, located radially distal from the outer surface 8, is radially bound by a base 21 and an inward facing land 24, such that the radial height 23 of the foot 22 is the radial distance between the base 21 and the land 24.

The neck portion 25, located radially between the foot 22 and the outer surface, includes a first and a second axial end wall 26. These end walls 26 each have a taper angle that, when viewed in the radial outward direction, narrows the neck portion 25. That is, at the interface between the neck portion 25 and the foot 22, the neck portion is axially wider than at the interface between the neck portion 25 and the outer surface 8.

In another exemplary embodiment (not illustrated), only one of the axial end walls 26 has a taper angle.

In an exemplary embodiment shown in FIG. 2, the foot 22 extends axially in two directions. This, in conjunction with the neck portion 25, provides the root with a T-shape. In a another exemplary embodiment (not illustrated), the foot 22 extends axially in one direction, providing the root with a L-shape.

The purpose of the channel 20 is to receive and hold a row of rotationally fittable blades 10, thus forming a circumferential blade row. A rotationally fittable blade 10 is here defined as a blade 10 that is configured and arranged to fit in the channel 20 by first insertion and then rotated to bring the blade into its required axial alignment using known rotation fitting methods and configuration as, for example, shown in FIG. 1. Typically, this requires that the platform 40 and/or root 30 are parallelogram shaped. Longitudinal sectional views of a fitted blade are shown in FIGS. 4 and 5.

Figure 3:
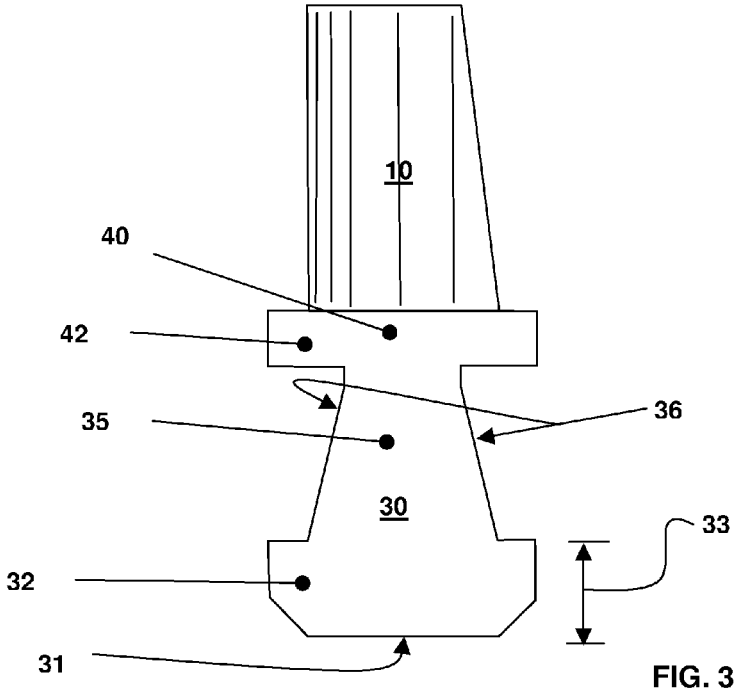
FIG. 3 is a perspective view of a blade of an exemplary embodiment.

In an exemplary embodiment shown in FIG. 3, each of the blades 10 had a root 30 wherein each root 30 has an axially extending foot 32. The foot 32 forms a radial end of the blade 10. A neck 35 radially extends from the foot 32. The foot 32 includes a base 31, which defines the radial end of the blade 10, and a radial height 33 extending from the base 31. The neck 35 includes a first and a second axial end wall 36. The end walls 36 have a taper that compliments the taper angle of the channel neck portion 25. In exemplary embodiments in which the first and second endwalls 36 of the neck portion 25 are tapered, first and second axial end walls 36 of the root are tapered. In exemplary embodiments in which only one endwall 26 of the neck portion 25 is tapered, only one axial end wall 36 is tapered. In this way, the taper angles minor each other, i.e., complement each other, thus enabling parallel alignment of the end walls 26,36 of the channel 20 and root 30 respectively, when the root 30 is positioned in the channel 20. This complementation can be seen in FIGS. 4 and 5.

Figure 4:
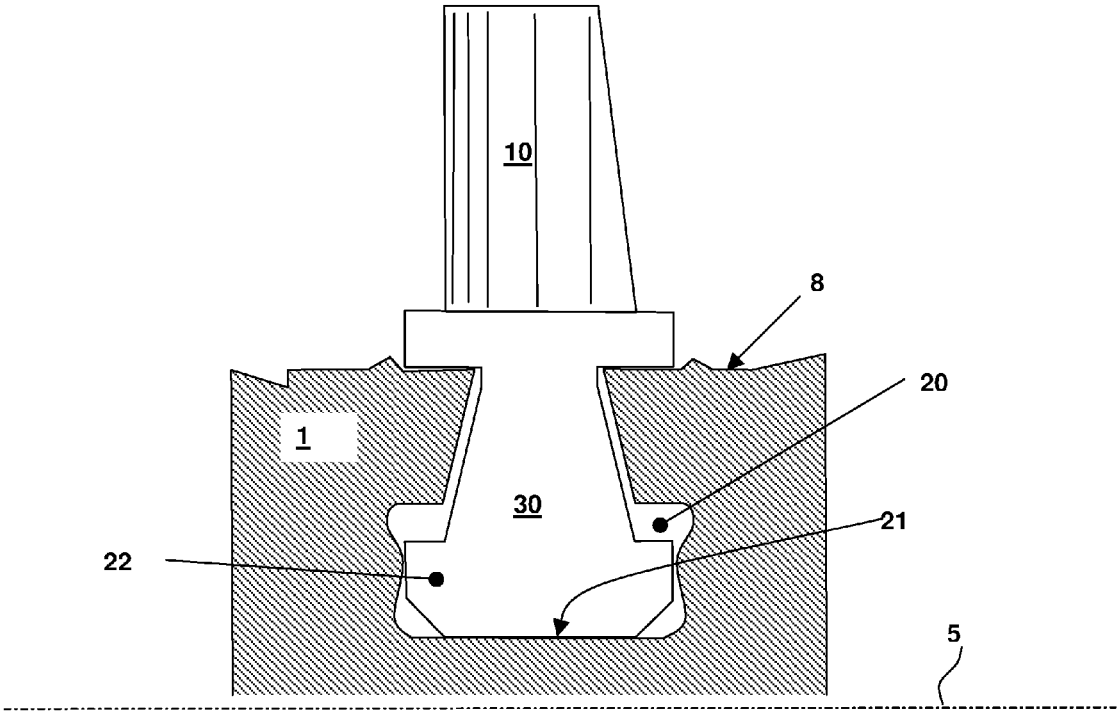
FIG. 4 is a section view of the exemplary blade fitted in the exemplary rotor.
Figure 5:
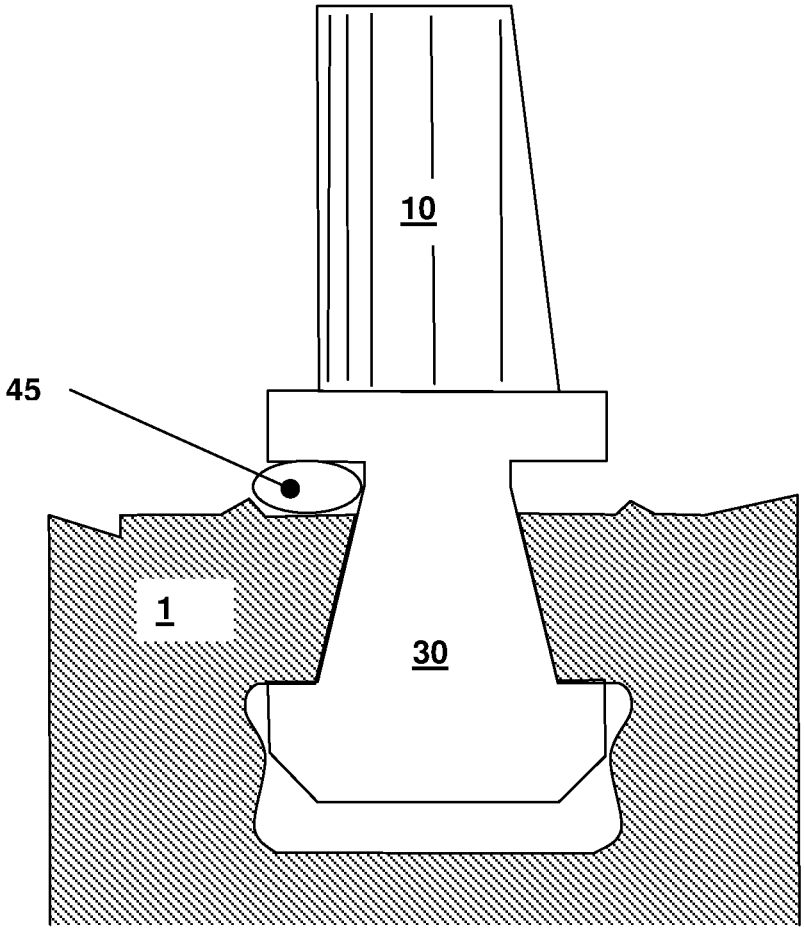
FIG. 5 is a sectional view of the blade and rotor of FIG. 4 including a biasing device.

In an exemplary embodiment, as shown in FIGS. 4 and 5, the foot 32 and neck 35 of the root 30 and the foot 22 and neck 25 of the channel 20 each complement each other in shape, such that the root 30 is fittable within the channel 20. The feet 22, 32 however, differ in that the radial height of the root foot 32 is less than the radial height of the channel foot 22. The height 23, 33 difference enables the root to be lowered while in the channel 20 while the taper angle results in a formation of a gap between the end walls 26,36 when this is done. This allows over-rotation of the blade 10 when the root base 31 is in contact with the channel base 21, as shown in FIG. 4, as compared to when the root foot 32 is in contact with the channel land 24, as shown in FIG. 5. In this way, over-rotation and additional fitting gap can be created in the channel 20 without the need to reduce the circumferential width of the root 30 that results in an undesirable circumferential gap between the roots 30 after the fitting of all roots 30. Over-rotation here is defined as rotation of the root 30 in the fitting direction past the point of operational axial alignment of the blade 10.

In an exemplary embodiment, when the blade 10 is raised such that the blade foot 32 makes contact with the channel land 24, as shown in FIG. 5, the radial gap no longer exists. In an exemplary embodiment, this contact prevents rotation of the blade 10 and is the typical arrangement of the root 30 in the channel 20 during turbine operation.

The size of the axial gap created by lowering the blade 10 is in part dependent on how far the blade can be lowered and the taper angle. Increasing both will generally, in the absence of other limitations, increase the amount of over-rotation that is possible. In an exemplary embodiment, these parameters are configured to enable the rotational fitting of a final blade in the blade row thus reducing or eliminating the need for root windows or the use of shims 3. The desirable amount of over-rotation, in order to achieve this aim, is highly dependent on rotor and blade sizing and therefore requires adaptation for each installation.

In an exemplary embodiment, the taper angle is between 3 to 9 degrees from the radial direction while in another exemplary embodiment, which may or may not be combined with this exemplary embodiment, the relative radial height difference between the root foot 32 and the channel foot 22 enables between 3 to 7 mm of radial movement of the root 30 in the channel 20.

In a further exemplary embodiment, the combination of the radial height 23, 33 difference and the taper angle provide a combined axial gap between both root end walls 36 and both channel end walls 25, of between 1 to 2 mm when the blade 10 is operationally aligned in the channel 20.

While during operation, centrifugal forces typically ensure the root 30 contacts the channel land 24, it may be desirable, due to, for example, the radial play of the root 30 in the channel 20, to fix the root 30 in the channel 20. This is achieved in an exemplary embodiment by each root 30 including a platform 40 on a radial distal end of the root 30 wherein the platform 40 has a lip 42, as shown in FIG. 3, configured to axially extend over a portion of the outer surface 8, when the root 30 is fitted in the channel 20, as shown in FIG. 5. In an exemplary embodiment having this arrangement, a biasing member 45 is located between the outer surface 8 and the lip 42. It radially biases the root foot 32 against the channel land 24, thus fixing the blade 10 in position in the channel 20. The biasing member 45 may be a rod caulked in position, a spring member, a plate, or any other known member that is capable of providing a biasing function.

In one exemplary embodiment, the biasing member 45 is located at one axial end of the roots 30 as shown in FIG. 5. In another exemplary embodiment, an addition biasing member 45 is located at another axial end of the roots 30 such that two biasing member 45 act upon the platform 40.

Although the disclosure has been herein shown and described in what is conceived to be the most practical means, exemplary embodiments may be embodied in other specific forms. For example, the blades of this disclosure are generally shown without shrouds, embodiments of the invention may incorporate shrouds. The presently disclosed embodiments are therefore considered in all respects to be illustrative and not restricted. The scope of the invention is indicated by the appended claims rather that the foregoing description and all changes that come within the meaning and range and equivalences thereof are intended to be embraced therein.

REFERENCE NUMBERS

1 rotor
2*a,b,c* fitted blade
3 shim
4 parallelogram shaped root/platform
5 rotational axis
8 outer surface
10 blade
20 channel
21 base (rotor)
22 foot (rotor)
23 radial height (rotor)
24 land
25 neck (rotor)
26 end walls
30 root
31 base (root)
32 foot (root)
33 radial height (root)
35 neck
36 end wall
40 platform
42 lip
45 biasing member While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

I claim:

1. A turbine assembly comprising:

a rotor having a rotational axis, an outer surface, and a channel formed in the outer surface and which circumscribes the rotor;

wherein the channel includes an axially extending channel foot with a base and a radially inward facing land, a radial distance between the base and the land defining a foot radial height, and a neck portion extending radially between the foot and the outer surface, the neck portion having a first and a second axial end wall, at least one of the first and second axial end walls having a taper angle which, in a radial outward direction, narrows the neck portion;

a row of rotationally fittable blades circumferentially distributed in the channel around the rotor, each blade comprising a root at least partially located in the channel, the root including an axially extending root foot with a base and a radial height extending from the base, a neck extending radially from the root foot having a first and a second axial end wall, each end wall tapered to complement the taper angle of the end walls of the channel neck portion, and a platform on a radial distal end of the root;

wherein the blades each have a parallelogram shaped platform, root, or both, the blades being rotationally fittable in the channel;

wherein the root radial height is less than the channel foot radial height;

wherein differences in radial height between the root and channel foot, the taper, and platform shape, root shape, or both, in combination allowing over-rotation of the root when the base of the root is in contact with the channel base as compared to when the root foot is in contact with the channel land to an extent that enables fitting of a last blade in the channel; and wherein the complementary taper of the neck axial end walls and the channel neck end walls prevents rotation in the channel when the root foot is in contact with the channel land.

2. The turbine assembly of claim 1 wherein the taper angle is between 3 to 9 degrees from a radial direction.

3. The turbine assembly of claim 1, wherein a relative radial height difference between the root foot and the channel foot enables between 3 to 7 mm of radial movement of the root in the channel.

4. The turbine assembly of claim 1, wherein a radial height difference between the root foot and channel foot and the taper angle enable the formation of a combined axial gap between both root end walls and both channel end walls of between 1 to 2 mm when the blade is operationally aligned in the channel.

5. The turbine assembly of claim 1, wherein: each root includes a platform on a radial distal end of the root; each platform has a lip that axially extends over a portion of the outer surface; and further comprising a biasing member located between the outer surface and the lip at an axial end of a fitted root which biases the root foot against the channel land.

6. The turbine assembly of claim 5, wherein the biasing member is a rod.

7. The turbine assembly of claim 5, wherein the biasing member is a spring member.

8. The turbine assembly of claim 5, wherein the biasing member is a plate.

* * * * *